US005974830A

United States Patent [19]

Colero

[11] Patent Number: 5,974,830

[45] Date of Patent: Nov. 2, 1999

[54] JEWELRY SUSPENSION HARNESS

[76] Inventor: Michael A. Colero, 51 Basttersea Crescent, North York, Ontario, Canada, M6L 1G9

[21] Appl. No.: 08/908,563

[22] Filed: Aug. 8, 1997

[51] Int. Cl.[6] ..... A44C 17/02

[52] U.S. Cl. ..... 63/26; 63/13; 63/23; D11/43; D11/79; D11/91; 29/10

[58] Field of Search ..... 63/13, 23, 26, 63/33, FOR 101; D11/43, 77, 78, 79, 86, 91; 29/10; 256/19, 32, 33, 57; 403/392

[56] References Cited

U.S. PATENT DOCUMENTS

| | | | |
|---|---|---|---|
| D. 155,167 | 9/1949 | Kerchner | D11/34 |
| 289,803 | 12/1883 | Bethea | 256/32 |
| D. 393,229 | 4/1998 | Milner | D11/79 |
| D. 405,023 | 2/1999 | Correa | D11/79 |
| 463,446 | 11/1891 | Dickey | 256/57 |
| 475,781 | 5/1892 | Lloyd | 24/131 R |
| 758,351 | 4/1904 | Cady | 248/465 |
| 837,615 | 12/1906 | Dover | 63/26 |
| 857,835 | 6/1907 | Ruggles | 256/33 |
| 1,098,865 | 6/1914 | Whitehill | 256/57 |
| 1,153,380 | 9/1915 | Fussell | 52/155 |
| 1,749,640 | 3/1930 | Martin | 256/57 |
| 1,807,898 | 6/1931 | Davidson | 256/57 |
| 3,964,187 | 6/1976 | Stumpf | 40/1.5 X |
| 3,974,662 | 8/1976 | Avedissian | 63/15 |
| 4,346,871 | 8/1982 | Mauduit | 256/10 |
| 4,421,145 | 12/1983 | Broberg, Jr. | 140/104 |
| 4,738,240 | 4/1988 | Aich | 125/30 |
| 4,813,246 | 3/1989 | Richards | 63/26 |
| 5,115,649 | 5/1992 | Amber | 63/26 |
| 5,188,679 | 2/1993 | Kretchmer | 148/538 |
| 5,437,167 | 8/1995 | Ambar | 63/26 |

FOREIGN PATENT DOCUMENTS

| | | | |
|---|---|---|---|
| 2471155 | 6/1981 | France | 63/23 |
| 673207 | 2/1990 | Switzerland | 63/26 |

*Primary Examiner*—Terry Lee Melius
*Assistant Examiner*—Andrea Chop
*Attorney, Agent, or Firm*—Renner, Kenner, Greive, Bobak, Taylor & Weber

[57] ABSTRACT

A jewelry suspension harness includes a piece of jewelry or stone having opposed front and back surfaces integral with a top edge and opposed side edges wherein the top edge has a top notch at about a midpoint between the side edges and the side edges have side notches substantially opposite one another. A suspension wire having opposed ends is provided with a loop that is nestled within the top notch wherein the suspension wire is placed adjacent the front and back surfaces and provided in a substantially parallel relationship with the side edges and wherein the suspension wire is coupled to the side notches to carry the piece of jewelry.

8 Claims, 5 Drawing Sheets

JEWELRY SUSPENSION HARNESS

TECHNICAL FIELD

The present invention herein resides generally in the art of jewelry mounting. More particularly, the present invention relates to the suspension of jewelry such as precious or semi-precious stones, glass, metal or like material. Specifically, the present invention relates to suspension of a piece of jewelry that is not easily dislodged or removed from a wire harness.

BACKGROUND ART

It is well known that jewelry in the form of precious stones, such as diamonds, rubies and the like or in the form of semi-precious stones, metal or glass and the like may be mounted to rings, necklaces or earrings. Some stones may be mounted in various ways such as by glueing or cementing the stone to a setting or mount so as to predominantly display the stone without attracting attention to the mount. In some instances, it is known to carry or support these stones with barrels that engage undercuts provided in the stone. This allows numerous stones to be set in a necklace, broach or the like without detracting from the appearance of the jewelry.

However, none of the aforementioned methods for setting the jewelry adequately provide structure or methodology for suspending jewelry. Although it is known to glue or cement the top portion of a stone to a mounting and then suspend the stone from the mounting, it has been found that this method is inadequate. In particular, the cement or glue tends to degrade after a period of use, causing the stone to release from the mounting, which in turn causes embarrassment to the unsuspecting wearer of the jewelry. Although the stone can be reattached to the mounting, it will be appreciated that some stones are lost and that the user or wearer may not wish to repair the jewelry due to the inconvenience.

DISCLOSURE OF INVENTION

In light of the foregoing, it is a first aspect of the present invention to provide a jewelry suspension harness which securely displays a piece of jewelry.

Another aspect of the present invention is to provide the piece of jewelry with front and back surfaces connected by opposed side edges and a top edge, wherein the opposed edges provide opposed side notches and the top edge provides a top notch at about a mid-point between the side edges.

Yet another aspect of the present invention, as set forth above, is to provide one embodiment with a suspension wire which has a loop positioned proximally near the top notch with ends draped over respective front and back surfaces and wherein a tie wire is wrapped around the side notches, the piece of jewelry and the suspension wire to allow for suspension of the jewelry.

Still another aspect of the present invention, as set forth above, is to tie the suspension wire in a suspension knot around the tie wire on the front and back surfaces to further secure the suspension wire to the piece of jewelry.

A further aspect of the present invention is to provide an alternative embodiment employing the piece of jewelry as set forth above and wherein the piece of jewelry is provided with a through hole between the front and the back surfaces.

Still a further aspect of the present invention, as set forth above, is to provide a suspension wire with a loop that is positioned proximally near the top notch and wherein the suspension wire is secured to the piece of jewelry by threading the wire around the side notches and through the hole and by twisting the suspension wire in strategic locations.

An additional aspect of the present invention, as set forth above, is to connect the opposed ends of the suspension wire to one another to form a band which is secured to the piece of jewelry by threading the band around the side notches and through the hole with strategically placed twists and loops.

Yet an additional aspect of the present invention, as set forth above, is to form a loop near the top notch, thread the band through the hole, extend portions of the band into respective side notches, re-insert the band through the hole, and form a final loop twisted with the loop, wherein the twist is nestled in the top notch.

Still another additional aspect of the present invention, as set forth above, is to extend adjacent portions of the band through the hole, into one side notch, reinsert the band through the hole and around the other side notch, insert the band into the hole again, and form a final loop for twisting with the loop, wherein the twist is nestled in the top notch.

The foregoing and other aspects of the present invention, which shall become apparent as the detailed description proceeds, are achieved by a jewelry suspension harness, comprising a stone having a top edge and at least two opposed side edges, each side edge having a side notch; and a suspension wire coupled to the side notches and twisted to provide a loop at the top edge.

Other aspects of the present invention are obtained by a jewelry suspension harness, comprising a stone having opposed front and back surfaces integral with a top edge and opposed side edges, the top edge having a top notch at about a mid-point between the side edges, the side edges having side notches substantially opposite one another; and a suspension wire having opposed ends, the suspension wire providing a loop nestled in the top notch, wherein the suspension wire is placed adjacent the front and back surfaces and provided in a substantially parallel relationship with the side edges, the suspension wire coupled to the side notches to carry the stone.

Still other aspects of the present invention are obtained by a method for securing a harness around a piece of jewelry, comprising the steps of providing a piece of jewelry having a top edge contiguous with opposed side edges; removing material from the piece of jewelry to form a top notch along the top edge and side notches along the side edges; cutting a suspension wire to length; and securing the suspension wire adjacent at least one of the notches.

Further aspects of the present invention are achieved by a method for securing a piece of jewelry for display by suspension from a carrying member, comprising the steps of providing a piece of jewelry with notches along at least two opposed edges and a hole; providing a suspension wire; forming a loop in the suspension wire for receiving the carrying member; and wrapping the suspension wire around the notches and through the hole wherein the loop is disposed adjacent to a top edge of the piece of jewelry for suspension by the carrying member.

BRIEF DESCRIPTION OF THE DRAWINGS

For a complete understanding of the objects, techniques and structure of the invention, reference should be made to the following detailed description and accompanying drawings wherein.

BEST MODE FOR CARRYING OUT THE INVENTION

Figure 3:
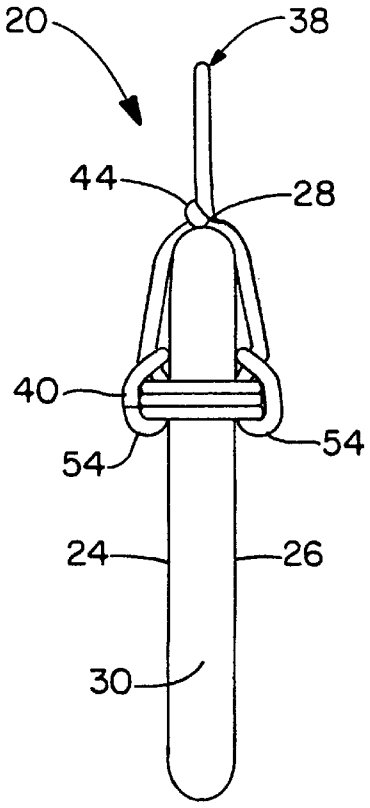
FIG. 3 is a side elevational view of the present invention.
Figure 2:
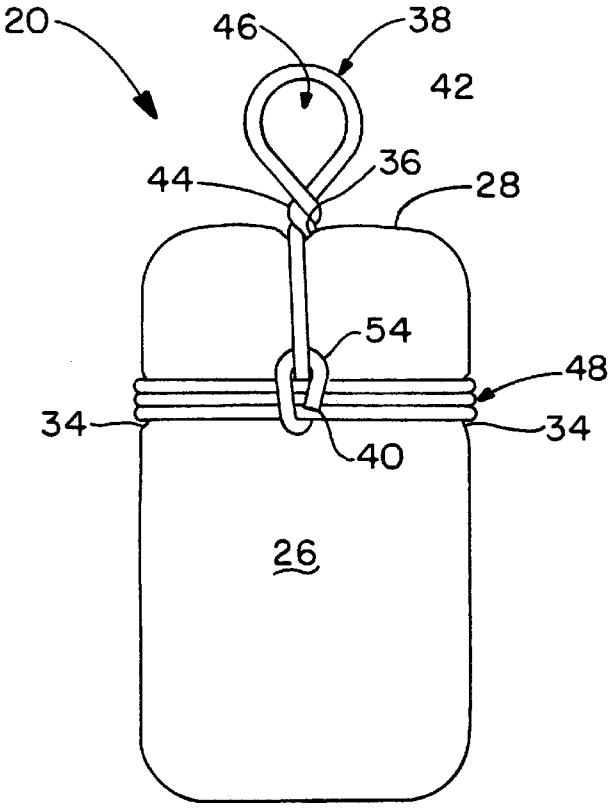
FIG. 2 is a rear elevational view of the present invention.
Figure 1:
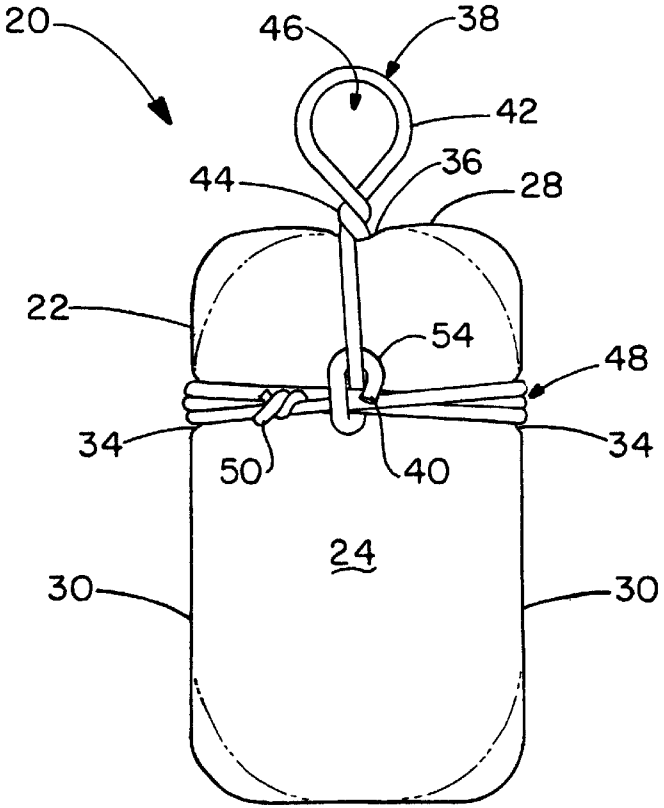
FIG. 1 is a front elevational view of a jewelry suspension harness according to the present invention.
Figure 6:
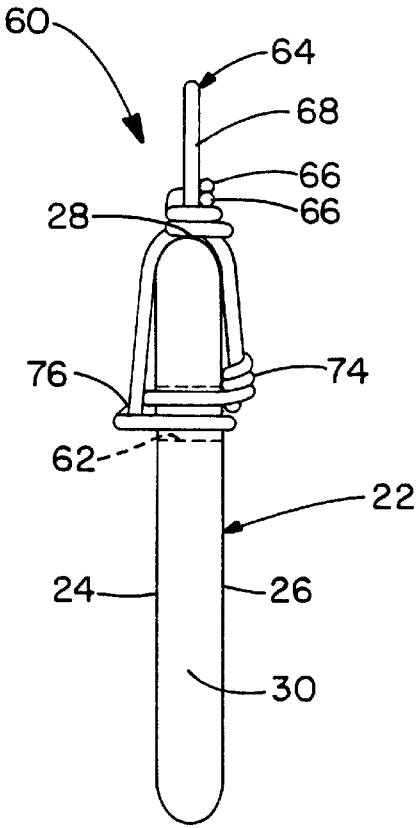
FIG. 6 is a side elevational view of the alternative embodiment.
Figure 5:
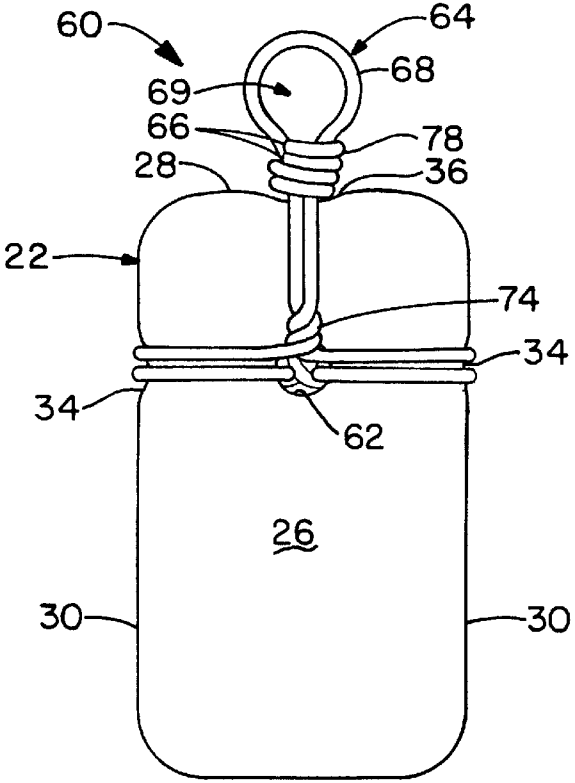
FIG. 5 is a rear elevational view of the alternative embodiment.
Figure 4:
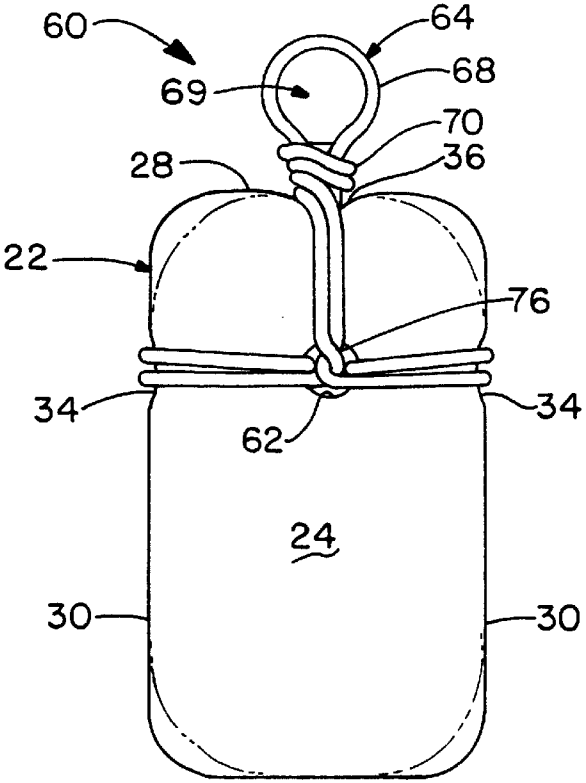
FIG. 4 is a front elevational view of an alternative embodiment according to the present invention.

Referring now to the drawings, and more particularly to FIGS. 1–3, it can be seen that a jewelry suspension harness according to the present invention is designated generally by the numeral 20. As shown, the jewelry suspension harness 20 carries a piece of jewelry such as a stone 22. It will be appreciated that the stone 22 may be a precious or semi-precious stone, colored glass, metal or any other type of material which a person may wish to wear as jewelry. As seen in the drawings, the stone 22 is generally rectangularly shaped and provides a relatively flat, thin profile with respect to its thickness. However, it will be appreciated that any size geometric-shaped stone, such as a sphere, a triangle, a cube, a cylinder or the like may be suspended by the structure and methodology presented hereinbelow.

The stone 22 includes a front surface 24 opposed by a back surface 26. The front surface 24 and the back surface 26 are connected by a top edge 28 and opposed side edges 30. The edges 28 and 30 may be rounded or presented with any type of cut.

The side edges 30 are provided with opposed side notches 34. The top edge 28 provides a top notch 36 usually at about a mid-point between the side edges 30. The notches 34 and 36 are usually formed by removing or grinding away the material of the stone 22 in a manner well known in the art.

A suspension wire 38, which is typically made of silver and has a diameter of about 0.32 mm, is draped over the stone 22. Of course, other types of wire material and other diameters of wire may be employed. The term wire, as used herein, may also include string, nylon line or any other strong, flexible material that can hold a shape indefinitely. In the event a string is used in place of wire, some type of adhesive material may be employed to hold the twists that are formed as discussed below. Opposed ends 40 of the suspension wire 38 are positioned such that one end 40 is draped adjacent the front surface 24 and the other end 40 is placed adjacent the back surface 26. The suspension wire 38 is positioned substantially parallel to the side edges 30.

A tie wire 48 may then be wrapped around the stone 22 any number of times such that the suspension wire 38 is captured adjacent the respective front and back surfaces 24, 26. In particular, the tie wire 48 is nestled within the side notches 34 and secured to the stone 22 by forming a tie twist 50. The tie wire 48 may be twisted around the stone 22 such that the opposed ends of the tie wire are placed adjacent one another and twisted to form the tie twist 50. Alternatively, the tie twist 50 may be formed by placing one end of the tie wire on the stone 22 and circularly wrapping the tie wire around the stone 22 and then tying or twisting the other end around a portion of the tie wire 48. It will be appreciated that the opposed ends could be soldered, glued or attached to one another by any other method known in the art.

A suspension knot 54 may then be formed by pulling each of the opposed ends 40 of the suspension wire 38 over the tie wire 48 and then threading the ends 40 underneath the suspension wire 38 at a position between the tie wire 48 and the top notch 36. In other words, the suspension wire 38 is coupled to the side notches 34 by the tie wire 48. Any excess length of the suspension wire 38 may then be trimmed flush so as not to detract from the appearance of the jewelry.

A loop 42 is then formed by twisting the suspension wire 38 to form a loop twist 44 having an aperture 46 therethrough. The loop twist 44 nestles in the top notch 36, causing the suspension wire 38 to lay relatively flat upon their respective front and back surfaces 24, 26. It will be appreciated that a carrying member such as a necklace or earring clip is insertable through the aperture 46.

This embodiment provides several advantages in its structure and method of securing the suspension wire to the stone 22. In particular, the side notches 34 effectively capture the tie wire 48 and preclude its slidable movement along the side edges 30. The tie twist 50 ensures that the tie wire 48 does not loosen and effectively holds the suspension wire 38 close to the respective front and back surfaces 24, 26 of the stone 22. Still another advantage of the present invention is that the loop twist 46 is nestled within the top notch 36 to preclude the suspension wire 38 from pivoting about the suspension knot 54. This further ensures that the harness 20 maintains a secure hold upon the stone 22.

Referring now to FIGS. 4–8, it can be seen that an alternative jewelry harness is designated generally by the numeral 60. As shown, the harness 60 is provided with a stone 22 which has essentially all of the same structural elements as in the first embodiment, and also provides a through hole 62 between the front surface 24 and the back surface 26. The hole 62 is positioned through the stone 22 at the intersection of a line between the opposed side notches 34 and a line that is substantially perpendicular thereto intersecting the top notch 36. However, it will be appreciated that the hole 62 may be placed anywhere through the front and back surfaces 24, 26, respectively, as deemed appropriate. In this embodiment, only one length of a suspension wire 64 with opposed ends 66 is employed and no other wires are associated with the harness 60.

Figure 8:
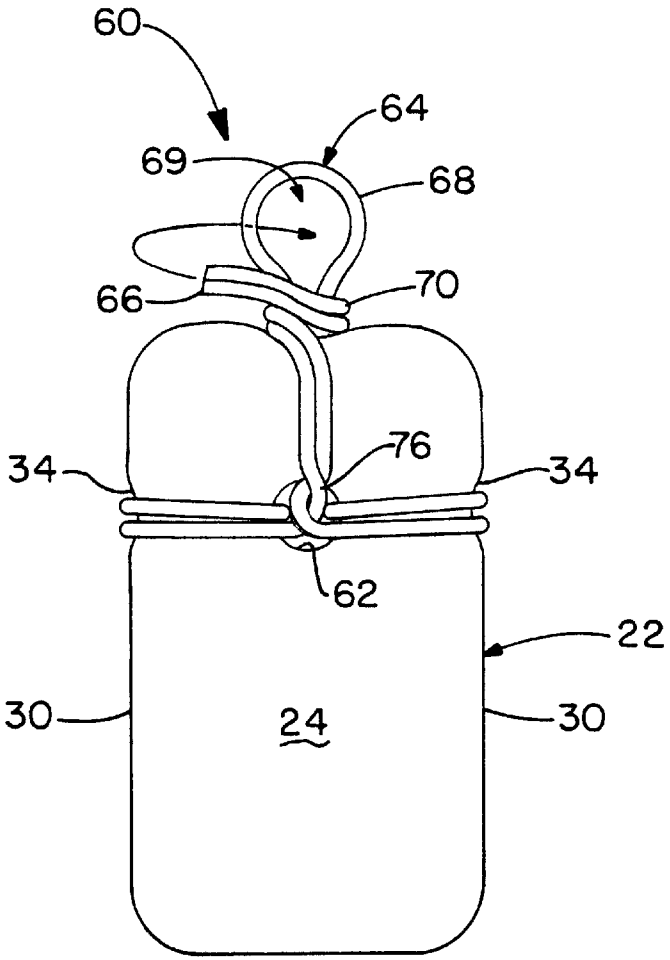
FIG. 8 is a second assembly drawing of the alternative embodiment.
Figure 7:
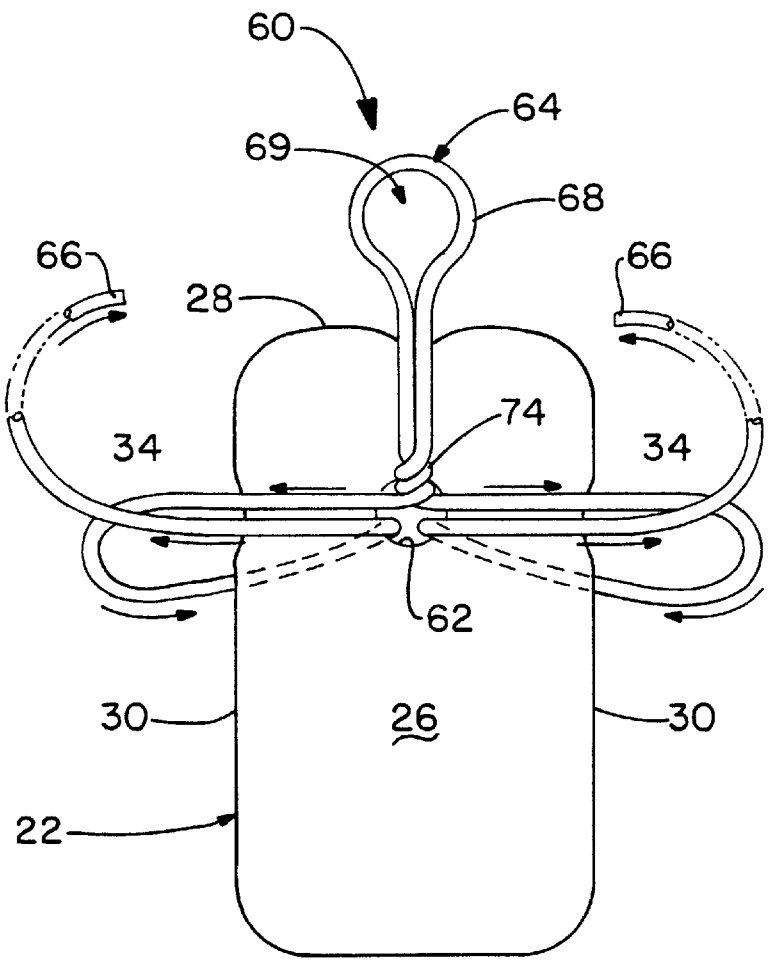
FIG. 7 is a first assembly drawing of the alternative embodiment.

As best seen in FIGS. 7 and 8, the harness 60 is formed by folding the wire 64 at about its midpoint such that the opposed ends 66 are initially placed proximal one another. A loop 68 is formed by a loop twist 70 at about the mid-portion of the suspension wire 64 and positioned near the top notch 36. Both opposed ends 66 are then draped over one of the surfaces 24 or 26 and then configured to form a hold twist 74 which is usually proximal the hole 62. The ends 66 are then extended in opposite directions along the first surface toward respective side notches 34. The opposed ends 66 are then wrapped around the side notches 34 and inserted through the hole 62 from the opposite surface. It will be appreciated that each end 66 of the suspension wire 64 may cross over within the hole 62 and extend in the same direction on the first surface. Alternatively, the ends 66 may be inserted through the hole 62 and extend in opposite directions on the first surface, as seen in FIG. 7. Next, the suspension wire 64 is wrapped around the first surface, the respective side notches 34 and disposed on the opposite surface. The opposed ends 66 are then directed toward one another on the opposite surface and a wrap twist 76 is formed proximally near the hole 62. The opposed ends 66 are then directed toward the loop 68 and wrapped about the loop twist 70 to form a lock twist 78. At this time, any excess length of the opposed ends 66 may be trimmed flush at the loop twist 70.

The alternative embodiment of the jewelry suspension harness 60 provides many of the same advantages as the harness 20. Additional advantages presented by the harness 60 are that only a single length of suspension wire 64 is required. Additionally, by employing the hole 62 and lacing the suspension wire 64 about the hole 62 and the notches 34, it will be appreciated that a more positive and secure attachment for the harness can be obtained. As in the previous embodiment, the notches 34 and 36 preclude slidable movement of the harness 60 and therefore ensure that the piece of jewelry or stone 22 is not released therefrom. It will also be appreciated that the weight of stone is primarily carried by the twists 74 and 76 and the portions of the wire 64 received in the side notches 34.

Figure 10:
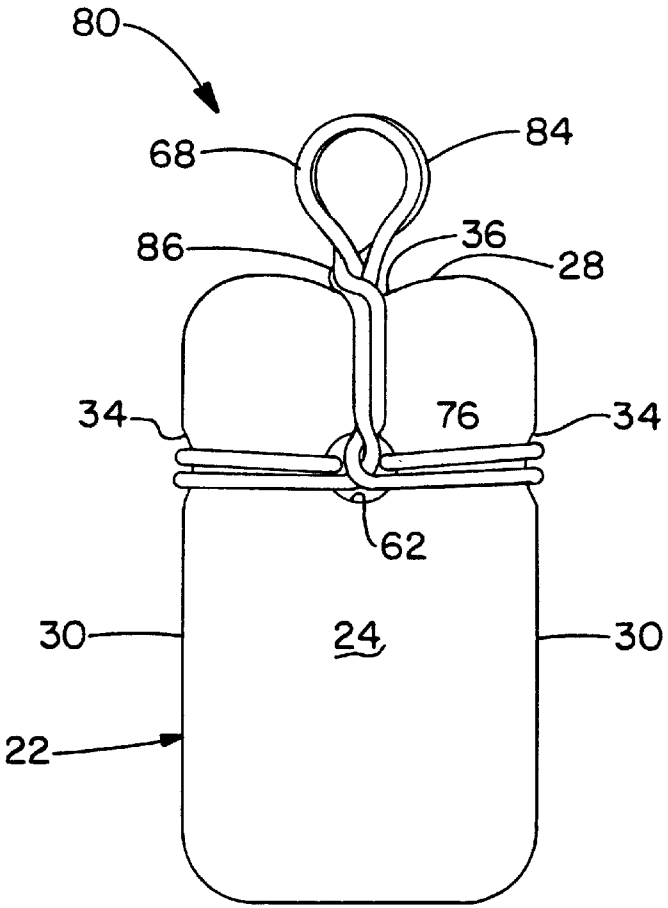
FIG. 10 is a second assembly drawing of the second alternative embodiment.
Figure 9:
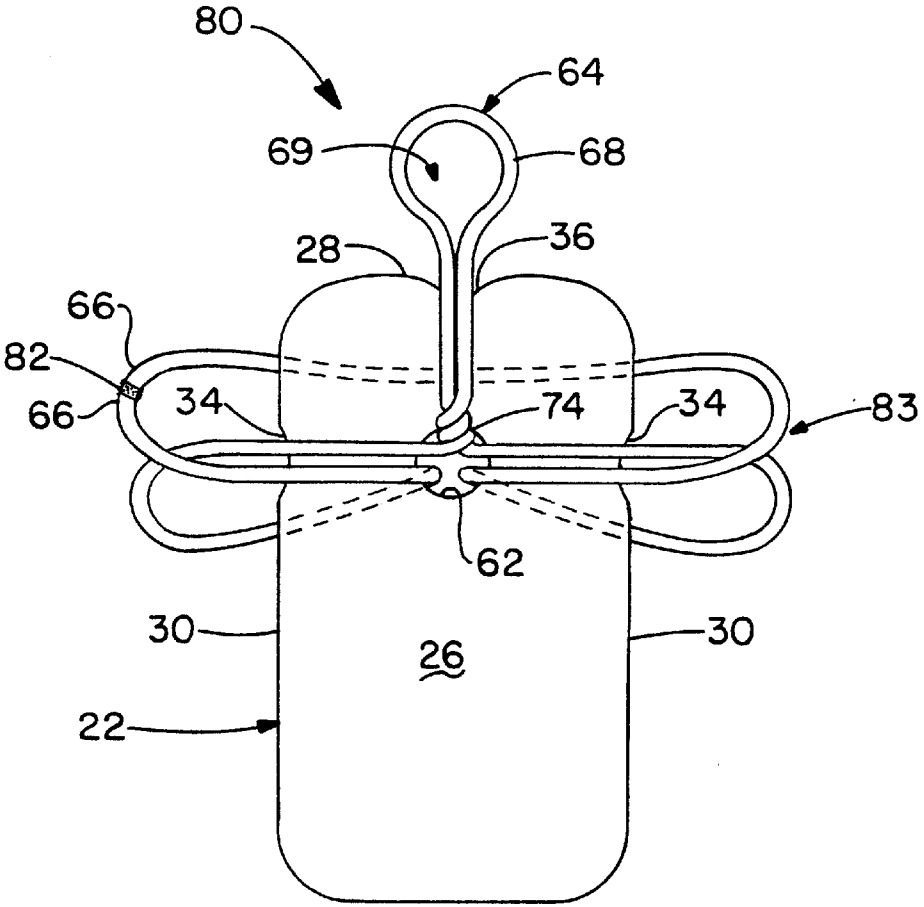
FIG. 9 is a first assembly drawing of a second alternative embodiment.

Referring now to FIGS. 9 and 10, it can be seen that a second alternative jewelry suspension harness is designated generally by the numeral 80. The second alternative harness is formed much like the harness 60; however, the opposed ends 66 are connected to one another by a solder connection 82 to form an endless band 83. Of course, the ends 66 may be connected with a crimp sleeve or tied in a knot.

The harness 80 is assembled in much the same manner as the harness 60. The major difference is that the wire 64 must be cut to a predetermined length prior to connection of the opposed ends. The wire 64 is then tied to the stone 22 in the manner described above. It will be appreciated that there is adequate slack in the band 83 to allow threading of portions of the suspension wire 64 around the side notches 34 and where appropriate to allow portions of the wire 64 to be placed adjacent one another. Upon completion of the wrap twist 76, the wire 64 is directed toward the top notch 36 where a final loop 84 is formed. A final twist 86 is then formed by twisting the final loop 84 to the loop 68. The final twist 86 is then nestled in the top notch 36.

The second alternative jewelry suspension harness is better suited for mass production. Although an added operation is required to connect the ends 66, the threading operation is simplified by not having to handle loose ends. Additionally, the final trimming operation is eliminated.

Figure 11:
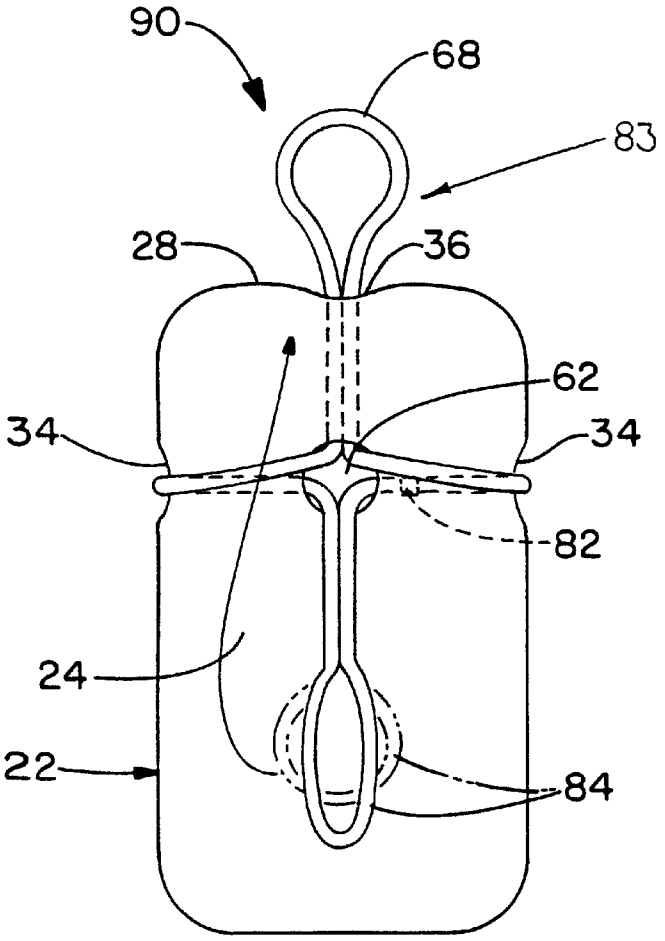
FIG. 11 is an assembly drawing of a third alternative embodiment.

Referring now to FIG. 11, it can be seen that a variation of the second alternative embodiment jewelry suspension harness is designated generally by the numeral 90. This variation suspends the stone 22 without benefit of the twists 74 and 76. To assemble this variation, one end of the band 83 is inserted through the hole 62. Adjacent portions of the band 83 are then separated and received in the respective side notches 34. The portions of the band are once again placed side-by-side and the band 83 is re-inserted through the hole 62. The final loop 84 is then formed and the final twist 86 (as seen in FIG. 10) is nestled into the top notch 36. It will be appreciated that the harness 90 could also be formed by maintaining the portions of the band adjacent one another throughout the insertion and threading steps. In particular, one end of the band 83 is inserted into the hole 62, wrapped around into one side notch 34, inserted into the hole 62 again, wrapped around the other side notch 34, and re-inserted through the hole 62. The final loop 84 is then formed along with the final twist 86. These variations, without the twists 74 and 76, allow the weight of the stone to be primarily carried by the portions of the wire 64 received in the side notches 34 and the hole 62. These variations also simplify production of the jewelry suspension harness.

Thus it can be seen that the objects of the invention have been satisfied by the structure and use of the invention as presented above. While in accordance with the patent statutes, only the best mode and preferred embodiment of the invention have been presented and described in detail, it is to be understood that the invention is not limited thereto or thereby. Accordingly, for an appreciation of the true scope and breadth of the invention, reference should be made to the following claims.

What is claimed is:

1. A jewelry suspension harness, comprising:

a piece of jewelry having a top edge and at least two opposed side edges, each said side edge having a transverse side notch, wherein said top edge has a transverse top notch discontinuous from said side notches and extending in the same orientational direction as said side notches and positioned at about a mid-point between said side edges;

a suspension wire coupled to said side notches and twisted to provide a loop at said top edge, wherein said suspension wire has a loop twist to form said loop, and wherein said loop is nestled in said top notch; and a tie wire wrapped around said piece of jewelry and received in said side notches, said tie wire securing said suspension wire to said piece of jewelry.

2. The harness according to claim 1, wherein said tie wire captures said suspension wire adjacent a front surface and a back surface of said piece of jewelry, said tie wire secured to itself by a tie twist, and wherein said suspension wire is secured to said tie wire by at least one suspension knot.

3. A jewelry suspension harness, comprising:

a piece of jewelry having opposed front and back surfaces integral with a top edge and opposed side edges, said top edge having a top notch at about a mid-point between said side edges, said side edges having side notches substantially opposite one another;

a suspension wire having opposed ends, said suspension wire providing a loop nestled in said top notch, wherein said suspension wire is placed adjacent said front and back surfaces and provided in a substantially parallel relationship with said side edges, said suspension wire coupled to said side notches to carry said piece of jewelry; and a tie wire wrapped around said suspension wire and said piece of jewelry for coupling to said piece of jewelry, said tie wire received in said side notches and secured to said piece of jewelry by a tie twist, said tie wire substantially perpendicular to said suspension wire, said suspension wire further secured to said tie wire by suspension knots on both said front and back surfaces.

4. A jewelry suspension harness, comprising:

a piece of jewelry having a top edge and at least two opposed side edges, each said side edge having a side notch, said piece of jewelry having a front surface and a back surface, said piece of jewelry having a hole through said front and back surfaces, and a suspension wire adjacent said front and back surfaces and wrapped in said side notches and through said hole, said suspension wire having at least one loop that extends from said top edge, wherein said suspension wire is directed along one of said front and back surfaces toward said hole and led into a hold twist, said suspension wire is wrapped into said side notches and directed through said hole and wrapped into said side notches again, and wherein said suspension wire is then tied into a wrap twist long the other of said front and back surfaces and directed toward said loop and secured thereto by a lock twist.

5. The harness according to claim 4, wherein said at least one loop extends axially from said top edge.

6. A jewelry suspension harness, comprising:

a piece of jewelry having opposed front and back surfaces integral with a top edge and opposed side edges, said top edge having a top notch at about a mid-point between said side edges, said side edges having side notches substantially opposite one another; and a suspension wire having opposed ends, said suspension wire providing a loop nestled in said top notch, wherein said suspension wire is placed adjacent said front and back surfaces and provided in a substantially parallel relationship with said side edges, said suspension wire coupled to said side notches to carry said piece of jewelry, wherein said piece of jewelry has a hole extending between said front and back surfaces at a point at the intersection of a line between said opposed side notches and a line substantially perpendicular thereto intersecting said top notch, said suspension wire having said loop formed at about a mid-point thereof, said opposed ends disposed adjacent one of said front and back surfaces and twisted into a hold twist proximal said hole, said opposed ends directed in opposite directions and each nestled in respective said opposed side notches, said opposed ends inserted through said hole, disposed on one of said front and back surfaces and nestled into respective said opposed side notches, said opposed ends twisted into a wrap twist proximal said hole adjacent the other of said front and back surfaces and disposed adjacent the other of said front and back surfaces, and said opposed ends twisted around said loop to form a lock twist.

7. A jewelry suspension harness, comprising:

apiece of jewelry having opposed front and back surfaces integral with atop edge and opposed side edges, said top edge having a top notch at about a mid-point between said side edges, said side edges having side notches substantially opposite one another; and a suspension wire having opposed ends, said suspension wire providing a loop nestled in said top notch, wherein said suspension wire is placed adjacent said front and back surfaces and provided in a substantially parallel relationship with said side edges, said suspension wire coupled to said side notches to carry said piece of jewelry, wherein said piece of jewelry has a hole extending between said front and back surfaces at a point at the intersection of a line between said opposed side notches and a line substantially perpendicular thereto intersecting said top notch, said suspension wire having said opposed ends connected to one another to form a band, said band having said loop formed with a loop twist, with portions of said suspension wire placed adjacent one another and disposed adjacent one of said front and back surfaces and twisted into a hold twist proximal said hole, portions of said band directed in opposite directions and each portion nestled in respective said opposed side notches, said band inserted through said hole, with portions of said band disposed on one of said front and back surfaces and nestled into respective said opposed side notches, said band twisted into a wrap twist proximal said hole adjacent the other of said front and back surfaces and disposed adjacent the other of said front and back surfaces, and said band twisted into a final loop with said loop to form a final twist.

8. A jewelry suspension harness, comprising:

a piece of jewelry having a top edge and at least two opposed side edges, each said side edge having a side notch, said piece of jewelry having a front surface and a back surface, said piece of jewelry having a hole through said front and back surfaces; and a suspension wire adjacent said front and back surfaces and wrapped in said side notches and through said hole, said suspension wire having at least one loop that extends from said top edge, wherein said suspension wire is connected at each end to form a band that is directed along one of said front and back surfaces toward said hole and tied into a hold twist, said band is wrapped into said side notches and directed through said hole and wrapped into said side notches again, said band is then tied into a wrap twist along the other of said front and back surfaces and directed toward said loop to form a final loop that is secured to said loop with a final twist.

* * * * *